US007234388B2

(12) United States Patent
Orr et al.

(10) Patent No.: US 7,234,388 B2
(45) Date of Patent: Jun. 26, 2007

(54) LINER RETENTION SYSTEM

(75) Inventors: Alan Orr, Tulsa, OK (US); Eric Thomas Greager, Owasso, OK (US); Ernest J. Jensen, Tulsa, OK (US)

(73) Assignee: Helmerich & Payne, Inc., Tulsa, OK (US)

( * ) Notice: Subject to any disclaimer, the term of this patent is extended or adjusted under 35 U.S.C. 154(b) by 427 days.

(21) Appl. No.: 10/823,481

(22) Filed: Apr. 13, 2004

(65) Prior Publication Data

US 2005/0223889 A1 Oct. 13, 2005

(51) Int. Cl.
*F16J 10/04* (2006.01)

(52) U.S. Cl. ..... 92/171.1

(58) Field of Classification Search ..... 92/171.1
See application file for complete search history.

(56) References Cited

U.S. PATENT DOCUMENTS

| | | | | |
|---|---|---|---|---|
| 7,318 | A | | 4/1850 | Brown |
| 1,418,379 | A | | 6/1922 | Karle |
| 3,327,643 | A | * | 6/1967 | Pangburn ..... 92/171.1 |
| 3,435,777 | A | | 4/1969 | Schaaf |
| 3,438,334 | A | | 4/1969 | Schaaf |
| 3,462,180 | A | | 8/1969 | Bunyan |
| 3,618,994 | A | | 11/1971 | Gepfert et al. |
| 3,624,880 | A | | 12/1971 | Justus et al. |
| 3,635,616 | A | | 1/1972 | Venkatesan |
| 3,842,718 | A | | 10/1974 | Malchow |
| 4,326,826 | A | | 4/1982 | Bunyan |
| 4,338,037 | A | | 7/1982 | Deminski |
| 4,566,372 | A | | 1/1986 | Zandel et al. |
| 4,878,815 | A | * | 11/1989 | Stachowiak ..... 92/171.1 |
| RE33,490 | E | | 12/1990 | Steinbock |
| 5,572,920 | A | | 11/1996 | Kennedy et al. |

* cited by examiner

*Primary Examiner*—F. Daniel Lopez
(74) *Attorney, Agent, or Firm*—Head, Johnson & Kachigian

(57) ABSTRACT

A liner retention system for a reciprocating pump having a piston and a piston rod operating in a cavity of a frame. The system includes a cylindrical liner for the piston and piston rod, the liner having a radially extending external shoulder. A liner clamp plate has a central opening receivable over the liner and a plurality of stud apertures. A plurality of studs extends from the frame, each stud terminating in a threaded end spaced from a module block. At least one compression sleeve has an inside diameter larger than an external diameter of the stud. Tensioner mechanism secures each stud to the liner clamp plate to thereby secure the cylindrical liner to the module block.

12 Claims, 3 Drawing Sheets

LINER RETENTION SYSTEM

BACKGROUND OF THE INVENTION

1. Field of the Invention

The present invention is directed to a liner retention system for a reciprocating pump. In particular, the present invention is directed to a novel liner retention system for reciprocating mud pumps used in drilling and workover rig applications, and well servicing pumps such as stimulating and cementing.

2. Background of Invention

Drilling fluid (sometimes referred to as "drilling mud"), which is often times a petroleum or water based fluid product, is used in drilling and workover rig applications.

Drilling fluid serves a number of important functions in the drilling operations. The drilling fluid serves to assist in cleaning the bottom of the wellbore hole and transports drill cuttings to the surface where they are removed. The drilling fluid also cools the drill bit and lubricates the drill stem. Additionally, the drilling fluid assists in supporting the walls of the wellbore and discourages entry of fluids into the well. Finally, the drilling fluid can reveal the presence of oil, gas or water that may enter the fluid from a formation being drilled and may reveal information about the formation through drill cuttings. A viscous drilling fluid will be capable of transporting more and heavier cuttings so viscous drilling fluid is encouraged and often additives are utilized to increase viscosity.

The drilling fluid at a drilling or workover rig site is utilized in a circulating system so that the drilling fluid may be reused. The time required for the drilling fluid to travel from pump suction to pump suction is known as a complete cycle.

Mud tanks, when part of a mud circulation system, can supply mud to a pump or pumps to begin circulation, receive the drilling fluid circulated out of the well and store reserve mud.

A reciprocating pump or pumps are utilized to move the drilling fluid from the surface through a series of pipes including a stand pipe and rotary hose and then downhole to the subterranean drilling location. The drilling fluid will often be moved thousands of feet down drill pipe and out small nozzles in a drill bit. Thereafter, the pumps circulate the drilling fluid back to the surface through an annulus where the drilling mud is passed through various conditioning equipment. The equipment may include a vibrating screen assembly and separator mechanisms to remove entrained solids such as rocks or drilling cuttings. Other equipment may include degassers and mud agitators.

A reciprocating pump is a positive displacement pump. A plunger or piston reciprocates (moves back and forth) inside a cylinder which in the present case is a replaceable cylindrical liner. The reciprocating movement of the piston displaces or moves the drilling fluid. Drilling rigs have utilized both single-acting triplex pumps and double-acting duplex pumps.

Mud pumps are known to operate at up to 2200 horsepower. These pumps can include cylinder liners which are required to be frequently changed and also inspected from time to time.

SUMMARY OF THE INVENTION

The present invention is directed to a liner retention system for a reciprocating pump for drilling fluid for use on a drilling or workover rig. The frame of the pump includes a cavity or cavities wherein piston rods and pistons operate and through which cylinder liners are accessed. The cavities are each closed on five sides with an open top.

The cylinder liner is in the form of an open cylinder having a radially extending external shoulder. The cylinder liner is received through an opening in the frame and then abuts against a module block. The module block is in fluid communication with the suction end and the discharge end of the pump so that the piston forces fluid through the circulating fluid system.

A rugged liner clamp plate has a central opening receivable over the external diameter of the cylindrical liner. The central opening has a diameter slightly larger than the outside diameter of the cylinder liner but less than the diameter of the radially extending external shoulder so that the liner clamp plate abuts against the shoulder.

A plurality of threaded studs extend from threaded openings in the module block. The studs extend from the module block through the frame and pass through corresponding stud apertures in the liner clamp plate.

A tensioning mechanism is used to secure at least two of the studs, in this case a multi-jack bolt tensioner, which is threadably secured to a stud after application of a hardened washer. Stud extenders are threadably secured to two of the studs. Thereafter, a compression sleeve is slipped over each of the stud extenders. After a hardened washer is applied over the end of the stud extender, a multi-jack bolt tensioner is secured to the stud extender. The multi-jack bolt through application of force through the compression sleeve, jacks the stud extender which, in turn,jacks the stud, thereby securing the stud to the liner clamp plate and thereby securing the cylindrical liner to the module block.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 1:
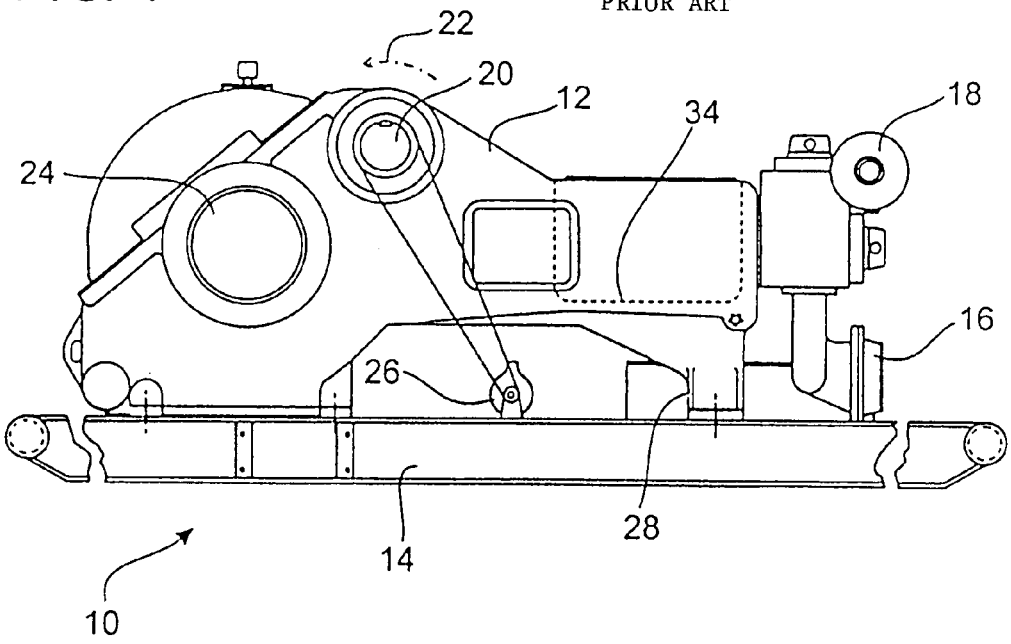
FIG. 1 PRIOR ART
FIG. 1 illustrates a known reciprocating pump for a drilling rig or workover rig which incorporates one example of a liner retention system which is the subject of the present invention.
Figure 2:
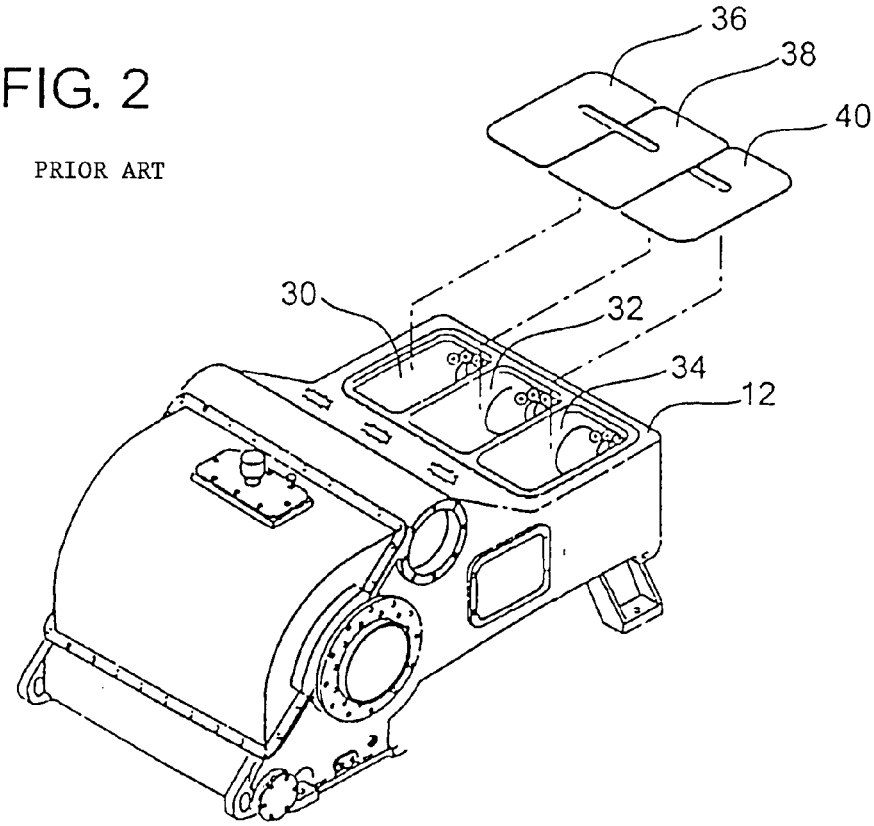
FIG. 2 PRIOR ART
FIG. 2 is a perspective view of a known frame for the pump shown in FIG. 1.

Referring to the drawings in detail, FIG. 1 illustrates a side view of a reciprocating pump for drilling fluid for use on a drilling or workover rig while FIG. 2 illustrates a perspective view of a frame 12 for the reciprocating pump apart from the pump. The reciprocating pump 10 may be mounted on a skid 14 so that it is self-contained and may be moved from location to location depending on the drilling site. The pump 10 includes a suction end 16 which may be connected to a drilling fluid tank in order to supply drilling fluid. The pump 10 will also include a discharge end 18 so that drilling fluid is forced through the circulating fluid system.

The pump 10 will include a shaft or jack shaft 20 which rotates in the direction shown by arrow 22. The jack shaft 20 rotates a pinion gear which in turn rotates a larger gear, sometimes known as a bull gear 24 which is attached to a crank shaft (not visible). The crank shaft is, in turn, connected to a connecting rod (not visible in FIG. 1). The pump may also include a rod washer pump 26 and a rod washer reservoir 28.

The frame 12 of the pump 10 includes a cavity or cavities 30, 32 and 34 wherein the piston rods and pistons operate and through which the liners are accessed. The cavities are each closed on five sides with an open top. Optional covers 36, 38 and 40 may be utilized to close the open tops. As will be described, the cylinder liners must be accessed in these cavities.

Figure 3:
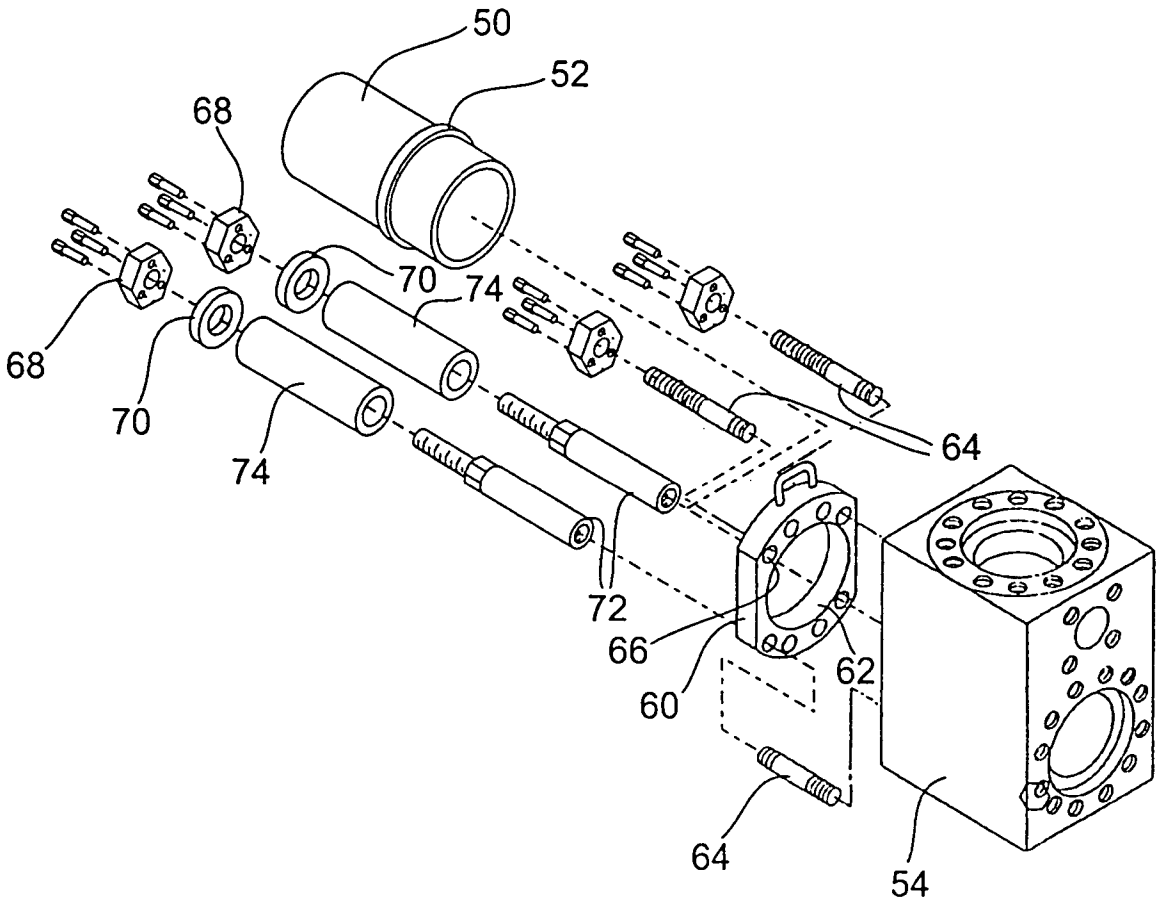
FIG. 3 is an exploded view of the liner retention system incorporated into the reciprocating pump shown in FIG. 1.
Figure 4:
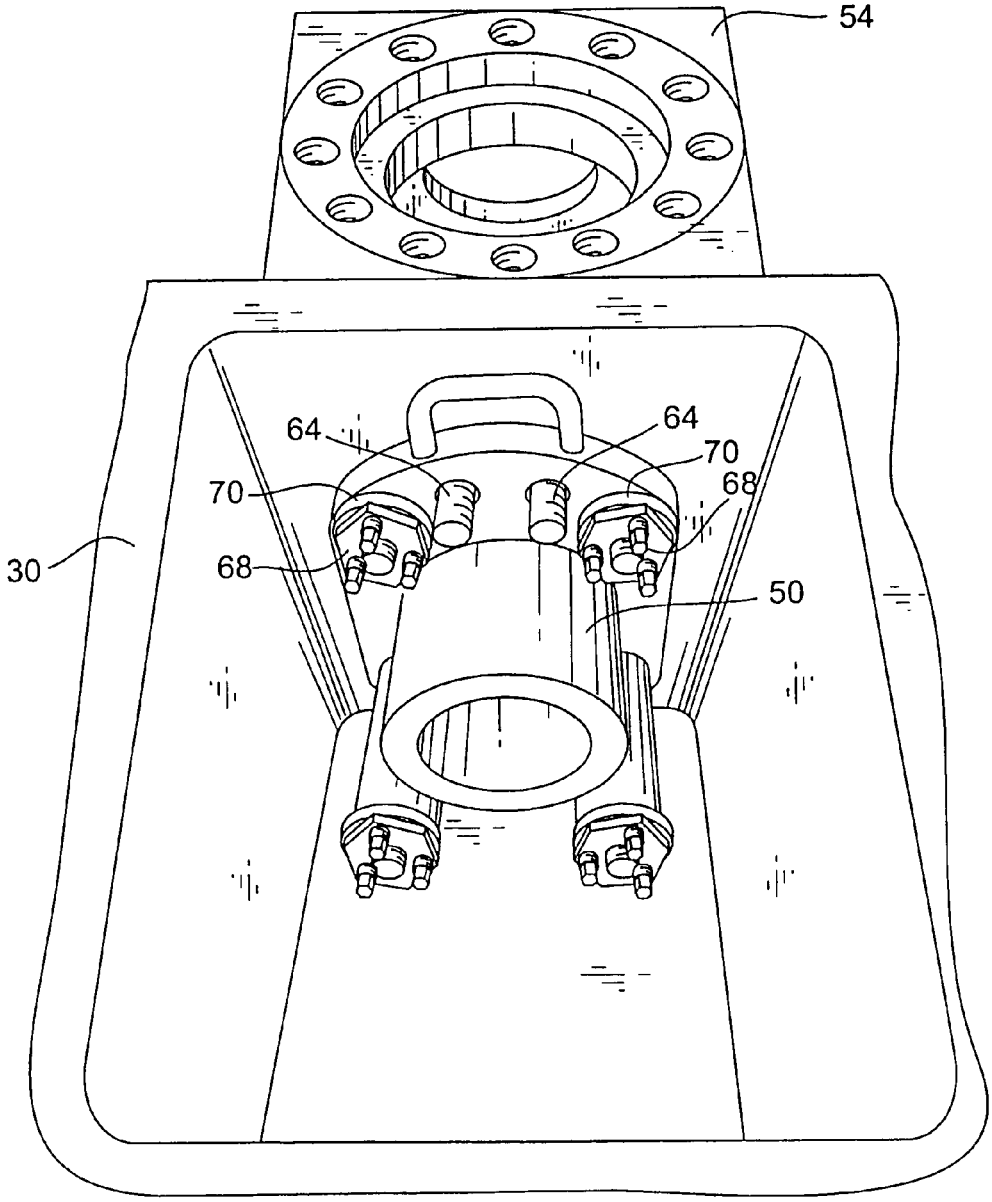
FIG. 4 is a perspective view of an assembled version of the liner retention system shown in FIG. 3.

FIG. 3 is an exploded, perspective view of the liner retention system of the present invention while FIG. 4 illustrates the liner retention system assembled in place holding a liner 50 with the piston rod and piston removed for clarity.

The liner 50 is in the form of an open cylinder having a radially extending external shoulder 52. The liner is received through an opening in the frame 30 and then abuts against a module block 54 (shown in exploded form in FIG. 3). The module block 54 will be in fluid communication with the suction end 16 and the discharge end 18 so that the piston forces fluid through the circulating fluid system.

A rugged liner clamp plate 60 has a central opening 62 which is receivable over the external diameter of the cylindrical liner 50. The central opening 62 has a diameter slightly larger than the outside diameter of the cylinder liner 50 but less than the diameter of the radially extending external shoulder 52 so that the liner clamp plate 60 will abut and force against the shoulder.

A plurality of threaded studs 64 extend from threaded openings in the module block 54. The studs 64 extend from the module block 54 through the frame 30 and pass through corresponding stud apertures 66 in the liner clamp plate 60.

By use of the present invention, the normal number of fasteners, in this case eight, are not required. Instead, it has been found that fastening four of the studs adequately secures the cylindrical liner 50 to the module block. The time and energy required to secure and unsecure the liner clamp plate is thereby reduced.

As best seen in FIG. 4, a tensioning mechanism is used to secure two of the studs, in this case a multi-jack bolt tensioner 68, which is threadably secured to the stud 64 after application of a hardened washer 70. Stud extenders 72 are threadably secured to two of the studs 64. Thereafter, a compression sleeve 74 is slipped over each of the stud extenders 72. After a hardened washer 70 is applied over the end of the stud extender, a multi-jack bolt tensioner is secured to the stud extender 72. The multi-jack bolt, through application of force through the compression sleeve 74, jacks the stud extender 72 which, in turn, jacks the stud 64, thereby securing the stud to the liner clamp plate and thereby securing the cylindrical liner to the module block.

It will be appreciated that an alternate tensioning mechanism, such as a hydraulic stud tensioner, might be employed instead of the multi-jack bolt arrangement.

Performing the operation in the reverse order will allow removal of the cylindrical liner 50.

It has been found that the present invention provides improved access to the components securing the cylinder liner to the module block, thereby enhancing personnel ergonomics and speeding cylinder liner changes.

Whereas, the present invention has been described in relation to the drawings attached hereto, it should be understood that other and further modifications, apart from those shown or suggested herein, may be made within the spirit and scope of this invention.

What is claimed is:

1. A liner retention system for a reciprocating pump having a piston and a piston rod operating in a cavity of a frame, which system comprises:

a cylindrical liner for said piston and said piston rod, said liner having a radially extending external shoulder;

a liner clamp plate having a central opening receivable over said liner and a plurality of stud apertures wherein said radially extending external shoulder engages said central opening in said liner clamp plate;

a plurality of studs, each said stud extending from a module block and terminating in a threaded end spaced from said module block;

at lease one compression sleeve having an inside diameter larger than an external diameter said stud extenders; and a tensioner to secure each said stud to said liner clamp plate and to thereby secure said cylindrical liner to said module block.

2. A liner retention system as set forth in claim 1 wherein said tensioner is a multijack bolt tensioner.

3. A liner retention system as set forth in claim 1 wherein at least one said stud includes a stud extender.

4. A liner retention system as set forth in claim 3 including two said stud extenders and two said compression sleeves.

5. A liner retention system as set forth in claim 1 wherein said liner clamp plate central opening has a diameter less than a diameter of said radially extending external shoulder.

6. A liner retention system as set forth in claim 1 wherein said cavity in said frame is closed on five sides.

7. A liner retention system as set forth in claim 1 including a hardened washer between each said compression sleeve and each said tensioning means.

8. A liner retention system for a reciprocating pump having a piston and piston rod operating in a cavity of a frame wherein said cavity is closed on five sides, which system comprises:

a cylindrical liner for said piston and said piston rod, said liner having a radially extending external shoulder;

a liner clamp plate having a central opening receivable over said liner wherein said central opening has a diameter less than a diameter of said radially extending shoulder;

a plurality of studs extending from a module block, each said stud terminating in a threaded end spaced from said module block, including a pair of stud extenders;

a pair of compression sleeves having an inside diameter larger than an external diameter of said stud extender; and a tensioner to secure each said stud to said liner clamp plate and to thereby secure said cylindrical liner to said module block.

9. A method to secure and retain a cylindrical liner for a reciprocating pump to a frame, which method comprises:

inserting said cylindrical liner in an opening within a cavity of said pump frame;

sliding a liner clamp plate over said cylindrical liner so that said clamp plate engages a radially protruding shoulder on said liner and so that a plurality of studs extending from said frame pass through a plurality of apertures in said clamp plate;

attaching a stud extender to at least one of said studs, wherein each said stud extender terminates in a threaded end spaced from a module block;

sliding a compression sleeve having an internal diameter larger than an external diameter of said stud extender; and tensioning each said stud to said clamp plate so that said liner thereby is secured to said module block.

10. A method as set forth in claim 9 wherein said steps are performed in reverse order to remove said cylindrical liner.

11. A method as set forth in claim 9 wherein said tensioning each said stud to said clamp plate includes threading a multijack bolt tensioner to each said stud.

12. A method as set forth in claim 9 including the step of reducing the number of said studs tensioned through use of said method.

* * * * *